US005995053A

United States Patent [19]

Curtis

[11] Patent Number: 5,995,053

[45] Date of Patent: Nov. 30, 1999

[54] MOTOR VEHICLE ANTENNA MOUNT

[76] Inventor: Frederick Curtis, 455 Vista Roma, Newport Beach, Calif. 92660

[21] Appl. No.: 08/832,919

[22] Filed: Apr. 4, 1997

[51] Int. Cl.[6] ..... H01Q 1/32

[52] U.S. Cl. ..... 343/715; 343/713; 343/765; 343/888; 343/906; 343/892; 343/900; 343/882

[58] Field of Search ..... 343/715, 765, 343/713, 888, 906, 892

[56] References Cited

U.S. PATENT DOCUMENTS

| | | | |
|---|---|---|---|
| 2,875,330 | 2/1959 | Padgett et al. | 455/269 |
| 3,852,757 | 12/1974 | Kaiser | 343/713 |
| 4,431,332 | 2/1984 | Dieges | 403/252 |
| 4,827,273 | 5/1989 | Friedberg et al. | 343/715 |
| 4,872,017 | 10/1989 | White | 343/715 |
| 4,987,422 | 1/1991 | Ryan | 343/713 |
| 5,410,327 | 4/1995 | Shakun et al. | 343/765 |
| 5,600,334 | 2/1997 | Whitehouse | 343/715 |

*Primary Examiner*—Robert Kim
*Assistant Examiner*—Layla G. Lauchman
*Attorney, Agent, or Firm*—Morland C. Fischer

[57] ABSTRACT

Antenna mounts to enable a conventional antenna to be securely attached to a motor vehicle, such as a standard pick-up truck, and electrically connected to a radio that is carried by the truck. To increase the strength of the antenna mounts and thereby reduce the possibility that the antenna will snap off when subjected to high winds and other loads, the mounts are located through an existing hole that is established in a wall which surrounds the bed of many pick-up trucks. In one case, where the antenna mount is substantially recessed within a cavity below the existing hole in the wall, a fastener secures the antenna mount to the bottom of the cavity. In another case, where the antenna mount is partially recessed within the cavity, a pair of L-shaped clips are attached between opposite sides of the antenna mount and the top of the wall.

20 Claims, 3 Drawing Sheets

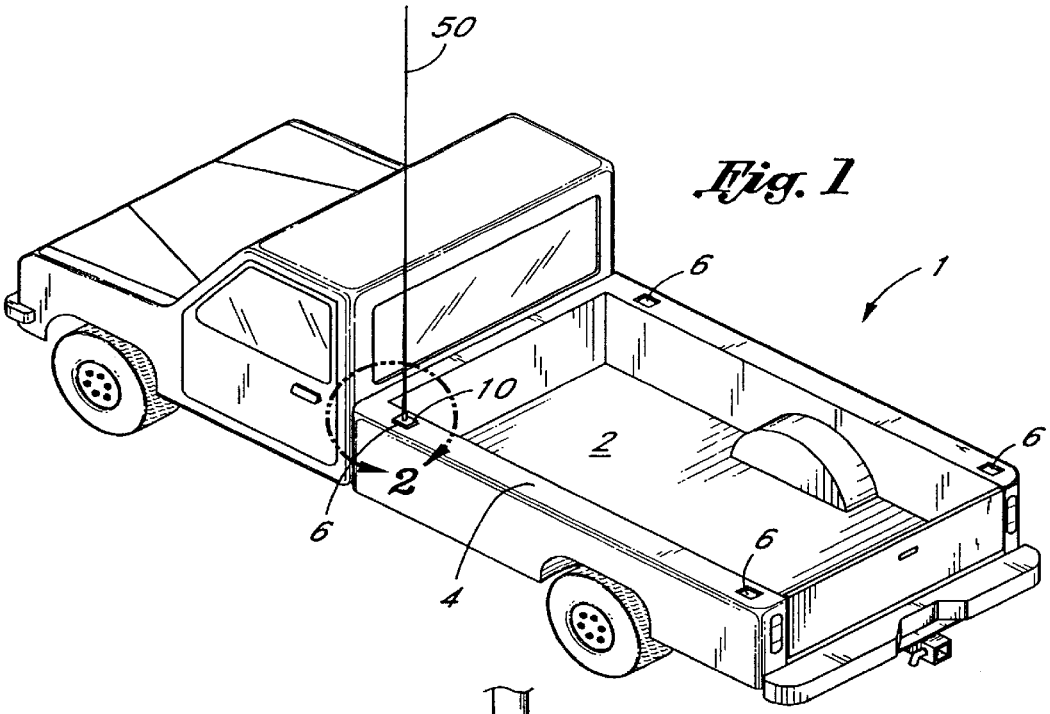
Fig. 1
Fig. 2
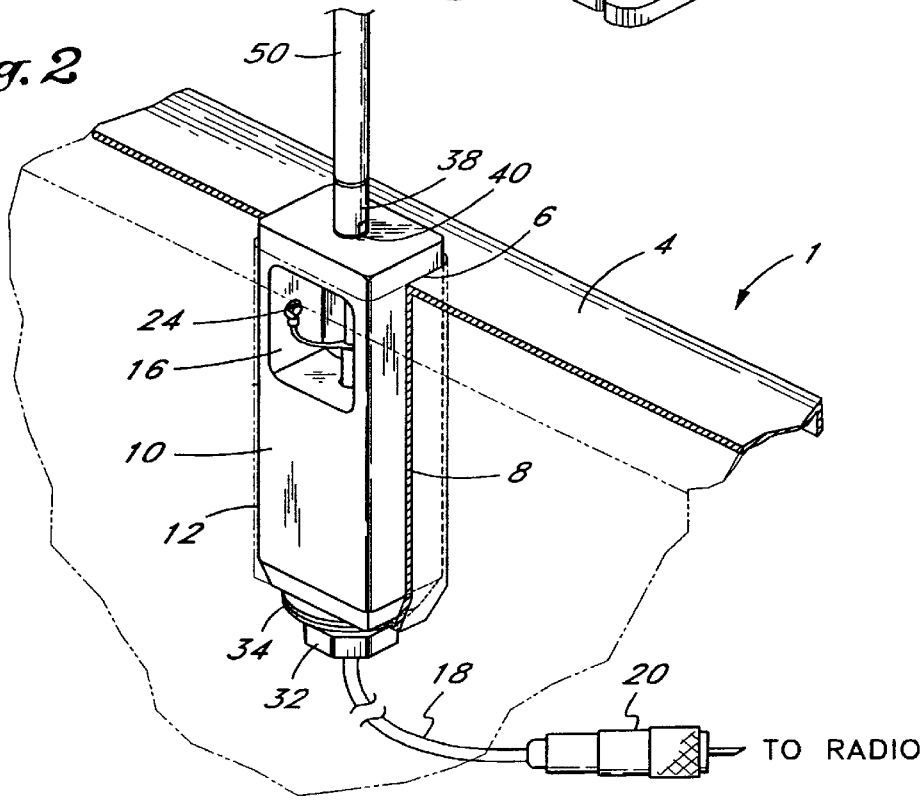

50
82
84
62
60
81
80
84
63
98
98
78
96
96
76
92
92
74
100
73
98
100
4
98
6
72
66
68
8
64
70
90
90
86
88
TO RADIO

MOTOR VEHICLE ANTENNA MOUNT

BACKGROUND OF THE INVENTION

1. Field of the Invention.

This invention relates to a high strength antenna mount that is received through an existing hole formed in the wall surrounding the bed of a motor vehicle (e.g. a pick-up truck) to enable an antenna to be securely attached to the vehicle while reducing the risk that the antenna mount will break under high wind and other load conditions to which the antenna is subjected during operation of the vehicle.

2. Background Art.

A variety of different radios (e.g. ham, commercial, CB, etc.) are commonly carried within the cab or passenger compartment of a vehicle to enable reception or two way communication over great distances. It is customary for the radio antenna to be mounted to the exterior of the vehicle. By way of example, antennas have been attached to the vehicle by means of mirror, bumper, side and window mounts, to name but a few. In many cases, alterations must be made to the vehicle to install the antenna mount. That is, holes must be drilled into the vehicle to accommodate the antenna mount and/or the electrical cables which extend between the antenna and the radio. Not only do these holes effect the appearance of the vehicle but they must be repaired in the event that the antenna and its mount are removed from the vehicle.

Due to the close proximity with the body of the vehicle, conventional antenna mounting locations are known to adversely effect the radiation pattern of the transmitted signal. What is more, conventional antenna mounts attached at the outside of the vehicle are undesirably susceptible to mechanical loads such as those caused by high winds and other impact forces to which the antenna may be subjected during operation of the vehicle. Consequently, the antenna mount may snap, whereby the antenna will be lost and operation of the radio will be interrupted.

What is needed is a strong antenna mount that may be securely attached to a motor vehicle without requiring any alterations to the vehicle to accommodate the mount and to enable the mount to reliably withstand high wind and other loads to which the antenna is subjected.

SUMMARY OF THE INVENTION

Antenna mounts are disclosed to enable a conventional antenna to be securely attached to and carried by a motor vehicle, such as a standard pick-up truck or the like. The antenna mounts include a casing manufactured from an electrically conductive material. To increase the strength of the antenna mounts and thereby reduce the possibility that the antenna will snap off when subjected to high winds and other loads, the mounts are inserted through and secured within an existing hole that is a standard feature in the wall which surrounds the bed of many pick-up trucks. In one case, where the casing of the antenna mount is substantially recessed within a cavity below the existing hole in the wall, a fastener secures the casing to the bottom of the cavity. In another case, the casing of the antenna mount is partially recessed within the cavity by a pair of L-shaped clips that are attached between opposite sides of the casing and the top of the protective bed liner.

In a first embodiment of the invention, the casing of the antenna mount includes a generally rectangular access opening disposed through the front and near the top of the mount. The outer shield at one end of a signal carrying coaxial cable is grounded against a wall of the access opening, and the center conductor of the coaxial cable is connected to an insulated antenna mounting nut that is held on top of the antenna mount by a bolt extending from the access opening through the casing. The coaxial cable runs through the casing of the antenna mount via a longitudinal cable access channel that extends from the access opening to enable the opposite end of the cable to be connected to a coaxial cable connector that is mated to a radio within the truck.

In a second embodiment, the casing of the antenna mount includes a pair of rectangular access openings disposed through the front and near the top and bottom, respectively, of the mount and a central channel extending between the top and bottom access openings for receiving a coaxial cable. The outer shield at one end of the coaxial cable is grounded against a wall of the top access opening, and the central conductor of the coaxial cable is connected to an insulated antenna mounting nut that is held on top of the antenna mount by a bolt extending from the top access opening through the casing. The coaxial cable runs through the central channel between the access openings to enable the opposite end of the cable to be connected to a first coaxial cable connector at the bottom access opening. The first coaxial cable connector is coupled to a second coaxial cable connector below the bottom of the antenna mount by means of a barrel connector that extends from the bottom access opening through the casing. The second coaxial cable connector is mated to a radio within the truck.

BRIEF DESCRIPTION OF THE DRAWINGS

FIG. 1 shows a truck of the type to which the antenna mounts of the present invention are secured;

FIG. 2 is a perspective view of an antenna mount according to a first embodiment substantially recessed within an existing cavity in the truck of FIG. 1;

DETAILED DESCRIPTION

Figure 3:
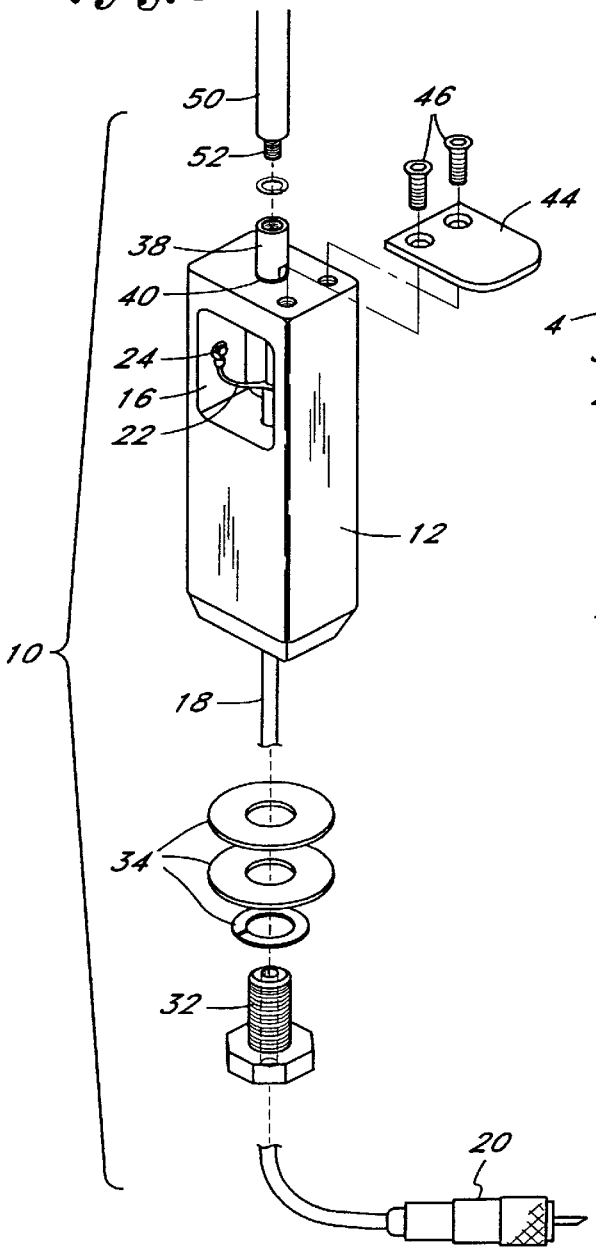
FIG. 3 is an exploded view of the antenna mount of FIG. 2.

FIG. 1 of the drawings shows a motor vehicle of the type to which the antenna mount 10 of the present invention is coupled so that an antenna 50 can be securely attached to and carried by the vehicle. By way of example, the vehicle illustrated in the drawings is a pick-up truck 1 manufactured by Ford Motor Company, General Motors Corporation, and the like. The truck 1 has a flat bed 2 at the rear and a mostly hollow wall 4 surrounding the front and sides of the bed 2. In many trucks 1 like that shown in FIG. 1, one or more holes 6 are formed through the wall 4 during manufacture. In this case, a pair of holes are established in each side of the wall 4 and located at opposite ends thereof. As will soon be explained, the antenna mount 10 of the present invention is sized and shaped to be accommodated by one of the existing holes 6 in the wall 4.

It may be appreciated that by virtue of using an existing hole 6 in which to locate the antenna mount 10, no structural changes need be made to the truck 1 before the antenna mount 10 can be installed. At the same time, it becomes a relatively quick and simple matter to install the antenna mount 10 so that the antenna 50 can be attached to and carried by the truck 1. Moreover, the truck 1 will be returned to its original condition in the event that a decision is made to remove the antenna mount 10 from its hole 6 and thereby detach the antenna from the truck 1.

FIG. 2 of the drawings shows the antenna mount 10 after installation through one of the existing holes formed in the wall 4 which surrounds the bed 2 of truck 1. The hole 6 is defined by a cavity 8 having elongated side walls that extend downwardly through the wall 4 for a distance of about six to seven inches. An end wall extends across the bottom of the cavity 8 so as to receive and support the bottom of the antenna mount 10 thereagainst. In the installed configuration of FIG. 2, the antenna mount 10 is disposed within the cavity 8 such that only a small portion of the mount projects upwardly and outwardly from the hole 6 in bed wall 4. With the antenna mount 10 substantially recessed within the cavity 8, as shown, the antenna 50 will be reliably attached to the truck 1 so as to be better able to withstand relatively high wind loads and impact forces that have been known to cause antennas to break off conventional antenna mounts.

Figure 4:
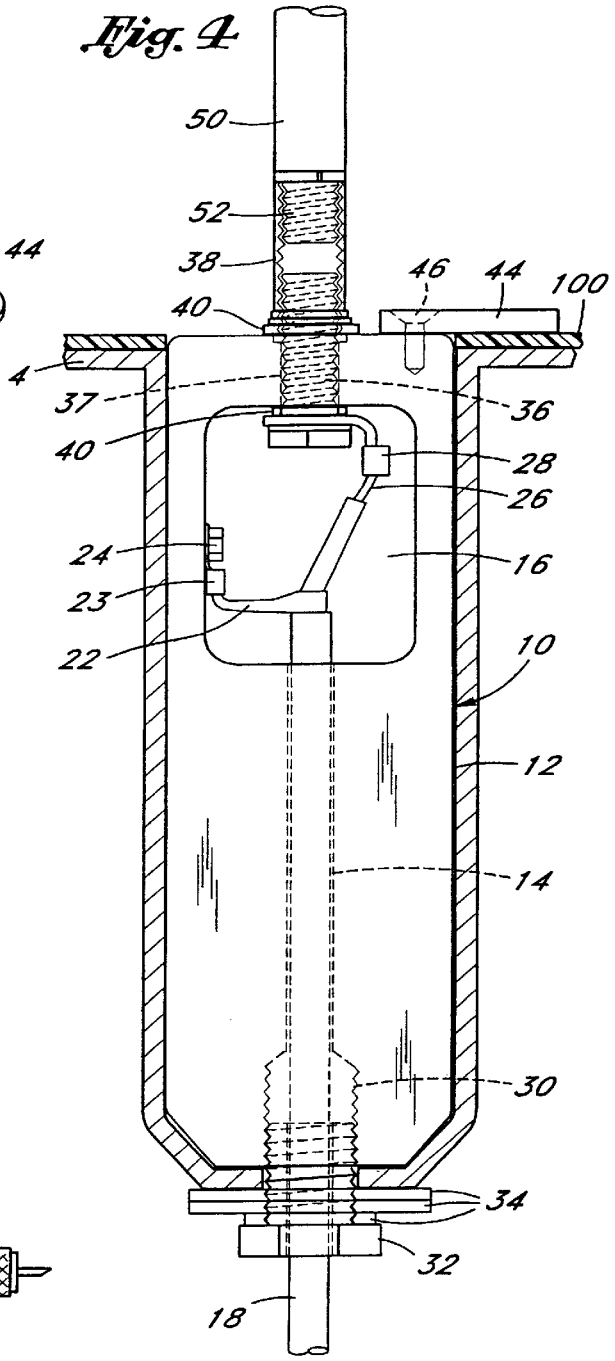
FIG. 4 is a front view of the antenna mount of FIG. 2 in the assembled configuration.

The details of the antenna mount 10 according to a first embodiment of this invention are now described while referring concurrently to FIGS. 3 and 4 of the drawings. The antenna mount 10 includes a body or casing that is preferably manufactured from a corrosion resistant, electrically conductive material such as aluminum alloy, or the like. The casing 12 of mount 10 is approximately 6 ½ inches long, 2 inches wide, and 1 ½ inches deep so as to easily fit through the existing hole 6 for receipt within the cavity 8 in the wall 4 of truck 1 (shown in FIGS. 1 and 2). However, it is to be understood that the precise dimensions of casing 12 are not to be considered a limitation of the present invention so long as the casing 12 is sized to fit through the hole 6.

A cable access channel 14 (shown in FIG. 4) runs longitudinally through the casing 12 from the bottom thereof to a rectangular access opening 16 that is formed through the front of antenna mount 10 near the top of casing 12. A coaxial cable 18, one end of which is connected to a conventional coaxial cable connecter 20 (shown in FIG. 3), extends through the cable access channel 14 of casing 12. The outer shield 22 at the opposite end of coaxial cable 18 is grounded by means of a solderless connector 23 and a suitable fastener 24 that connects outer shield 22 to the electrically conductive casing 12 at a wall of the access opening 16. The signal carrying conductor 26 at the center of coaxial cable 18 is affixed to a solderless connector 28 within the access opening 16 (shown in FIG. 4).

A threaded hole 30 (shown in FIG. 4) is formed upwardly through the bottom of the casing 12 of antenna mount 10. The hole 30 is sized to receive a correspondingly threaded mounting or tie down bolt 32, whereby to anchor the antenna mount 10 within the cavity 8 in the wall 4 of truck 1. The mounting bolt 30 has a hollow passage extending therethrough within which to receive the coaxial cable 18 between cable connector 20 and the access opening 16 of casing 12 of antenna mount 10. As is best shown in FIG. 2, a set of conventional washers 34 (including one or more flat washers and a lock washer) surround the shank of mounting bolt 32 between the bolt head and the bottom of the cavity 8 to provide spacing therebetween.

A threaded bolt 36 extends upwardly from within the access opening 16 of casing 12 through the top of the antenna mount 10 via a hole 37 formed through casing 12. The bolt 36 is connected to the center conductor 26 of coaxial cable 18 at the solderless connector 28. The threaded shank of bolt 36 which extends outwardly from the top of the antenna mount 10 is mated to a correspondingly threaded antenna mounting nut 38 in order to secure the nut 38 to the casing 12. A set of washers, including a pair of flanged insulating washers 40, surrounds the shank of the bolt 36 at the interface of bolt 36 with the top of the casing 12 and the mounting nut 38. The insulating washers 40 serve to isolate the antenna 50 from the electrical ground of the casing 12 in order to complete an electrical circuit from the signal carrying conductor 26 of coaxial cable 18 to antenna 50.

Once the antenna mount 10 is assembled in the manner described above with the casing 12 being substantially recessed within and anchored flush against the bottom of the cavity 8, a conventional antenna 50 is coupled to the antenna mount 10. That is, a threaded nub 52 of antenna 50 (shown in FIG. 3) is mated to the threaded antenna mounting nut 38. Therefore, the antenna 50 is electrically connected to the coaxial cable connector 20 via bolt 36, solderless connector 28, and the signal carrying conductor 26 of the coaxial cable 18. The coaxial cable connector 20 is then plugged into a suitable radio (not shown) of the truck 1 so as to permit the radio to be operated and the truck driven with the antenna 50 securely and reliably held in place above the hole 6 in the bed liner 4 by means of the antenna mount 10 being affixed to the bottom of cavity 8.

As an option to the first embodiment described when referring to FIGS. 1–4, at least one rectangular bed liner hold down plate 44 is secured to the top of the casing 12 of antenna mount 10 by means of conventional fasteners 46. Although only a single hold down plate 44 is shown connected to and extending from casing 12, it is to be understood that a pair of such hold down plates 44 can be secured to antenna mount 10 so as to extend outwardly and in opposite directions from the top of the casing 12. The single hold down plate 44 being show extends in a sideways direction from the casing 12 to perform the dual functions of stabilizing the antenna mount 10 within the hole 6 through the wall 4 of truck 1 while also applying pressure against the bed liner 48 in those trucks having a protective (e.g. plastic) bed liner covering the wall 4 which surrounds the truck bed 2. By virtue of the hold down plate 44, the bed liner 48 will be more reliably retained against the wall 4 of truck 1 with less chance of flying off or becoming separated from the wall 4.

Figure 5:
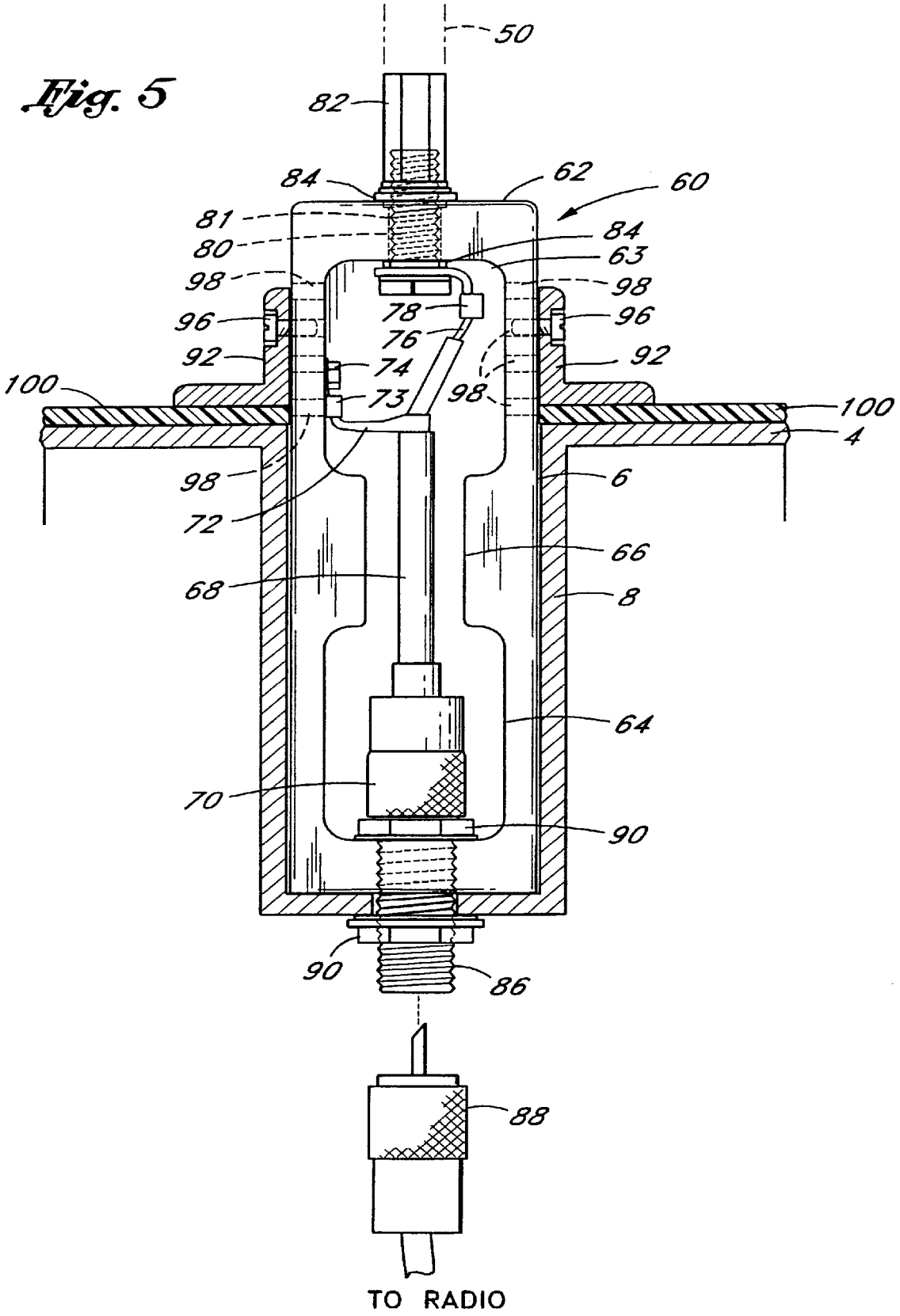
FIG. 5 shows an antenna mount according to a second embodiment partially recessed within the existing cavity of the truck of FIG. 1.

FIG. 5 of the drawings shows a second embodiment for an antenna mount 60 to which the antenna 50 can be securely attached. Like the antenna mount 10 of FIGS. 1–4, the antenna mount 60 of FIG. 5 is received through an existing hole 6 formed in the wall 4 surrounding the bed 2 of a motor vehicle, such as the pick-up truck 1 illustrated in FIG. 1. Although the antenna mount 60 is sized to be accommodated by the cavity 8 below the hole 6, the antenna mount 60 of this embodiment is adapted to project upwardly and out of the cavity 8, rather than being substantially recessed therewithin, as in the case of the antenna mount 10 of FIGS. 1–4.

More particularly, the antenna mount 60 includes a casing 62 that is manufactured from a corrosion resistant, electrically conductive material. Casing 62 has the same dimensions as the casing 12 of antenna mount 10 except that casing 62 may be 1 to 1 ½ inches longer. Generally rectangular top and bottom access openings 63 and 64 are formed through the front of antenna mount 60 near the top and bottom, respectively, of the casing 62. The top and bottom access openings 63 and 64 communicate with one another via a relatively narrow and centrally disposed cable channel 66. A signal carrying coaxial cable 68 runs through the cable channel 66 in casing 62 between the top access opening 63 and a first coaxial cable connector 70 that is located within the bottom access opening 64.

One end of the coaxial cable 68 is connected to coaxial cable connector 70 at the bottom access opening 64. The opposite end of coaxial cable 68 is connected to the casing 62 and the antenna 50 at the top access opening 63 in the same way that coaxial cable 18 is connected to the antenna mount 10 of FIG. 4. That is to say, the outer shield 72 of coaxial cable 68 is grounded by means of a solderless connector 73 and a suitable fastener 74 that connects outer shield 72 to the casing 62 of antenna mount 60 at a wall of top access opening 63. The signal carrying conductor 76 at the center of coaxial cable 68 is affixed to a solderless connector 78. The solderless connector 78 is connected to a threaded bolt 80 which projects upwardly through and outwardly of the top of casing 62 from the top access opening 63 via a hole 81 formed through casing 62.

A screw threaded antenna mounting nut 82 is mated to the threaded bolt 80 at the top of the casing 62 so as to receive the antenna 50 that is to be coupled to the radio of truck 1. A set of washers, including a pair of flanged insulating washers 84, surrounds the shank of the bolt 80 at the interface of bolt 80 with the top of the casing 62 and the antenna mounting nut 82 so that the antenna 50 will be isolated from the electrical ground of the casing 62 and connected in an electrical circuit to the signal carrying conductor 76 of coaxial cable 68.

A well known barrel connector 86 having threads running along the exterior thereof, extends through axially aligned holes formed in the bottom of the casing 62 of antenna mount 60 and the adjacent bottom of the cavity 8. One end of the barrel connector 86 is connected to the first coaxial cable connector 70 at the bottom access opening 64, and the opposite end of barrel connector 86 is adapted to be quickly and conveniently connected to a second coaxial cable connector 88 outside the antenna mount 60 and below the bottom of cavity 8. Sets of fasteners 90 surround the barrel connector 86 within the bottom access opening 64 and below the bottom of the cavity 8 to reliably anchor the antenna mount 60 within cavity 8. The first and second coaxial cable connectors 70 and 88 that are electrically coupled to one another by barrel connector 86 connect the signal carrying center conductor 76 of coaxial cable 68 to a suitable radio (not shown) so as to permit the radio to be operated and the truck driven with the antenna 50 being securely attached to the truck 1 and held in place above the hole 6 in the wall 4 around the truck bed 2 while the antenna mount 60 is partially recessed within and anchored flush against the bottom of the cavity 8.

As an option to the second embodiment described when referring to FIG. 5, a pair of L-shaped clips 92 are located at opposite sides of the casing 62 of antenna mount 60. Although a pair of L-shaped clips 92 are shown, it is to be understood that a single clip 92 attached to one side of casing 62 may also be used. A hole is formed in the vertical side of each L-shaped clip 92 to receive a fastener 96. The vertical sides of clips 92 are secured flush against opposite sides of the antenna mount 60 near the top of casing 62 by positioning the fasteners 96 through respective holes 98 in the casing 62. A series of holes 98 that are spaced one above the other may be established through the sides of casing 62 to receive the fasteners 96.

In this way, the position of antenna mount 60 within cavity 8 can be selectively adjusted depending upon the depth of the cavity 8 and the corresponding holes 98 from the series of holes that are chosen to receive respective fasteners 96. Accordingly, the lower the holes 98 selected, the less the antenna mount 60 will be recessed within cavity 8. A tight fit is preferred between the side and bottom of clips 92 against the opposing surfaces of wall 4 and casing 62 so as to prevent water from entering the hole 6 through wall 4 in which antenna mount 60 is located.

The use of clips 92 as described above may be desirable in cases where a protective bed liner 100 covers the wall 4 which surrounds the truck bed 2. Thus, like the bed liner hold down plate 44 of the antenna mount 10 of FIGS. 1–4, the L-shaped clips 92 of the antenna mount 60 of FIG. 5 also perform the dual functions of stabilizing the antenna mount 60 within the hole 6 through the wall 4 of the truck 1 while the horizontal legs of the clips 92 are seated upon and apply pressure against the bed liner 100. By virtue of the foregoing, the bed liner will be more securely held down against the wall 4 of the truck 1 with less chance of flying off or becoming separated from the wall 4.

It will be apparent that while the preferred embodiments of the invention have been shown and described, various modifications can be made without changing the true spirit and scope of the invention. For example, while the antenna mount 10 of FIGS. 1–4 is shown having a bed liner hold down plate 44 and the antenna mount 60 of FIG. 5 is shown having L-shaped clips 92, it is to be understood that the installation of these antenna mounts can be reversed such that antenna mount 60 is substantially recessed within cavity 8 and includes the bed liner hold down plate 44 while antenna mount 10 is only partially recessed by means of the L-shaped clips 92.

Having thus set forth the preferred embodiments, what is claimed is:

1. In combination:

a motor vehicle having a body, a radio, an antenna to transmit and receive radio signals, at least on hole formed in the body, and a cavity extending through said body from said hole and having a closed bottom, wherein said motor vehicle is a truck and said motor vehicle body includes a rear bed and a hollow wall surrounding said rear bed and having said one hole formed in said wall and said cavity extending through said wall; and an antenna mount to which said antenna is attached, said antenna mount having a casing that is located in said hole of said hollow wall for receipt by said cavity through said wall, and means by which to electrically connect said antenna to said radio.

2. The combination recited in claim 1, further comprising at least one clip extending between the casing of said antenna mount and the body of said motor vehicle so as to retain said antenna mount located within said cavity.

3. The combination recited in claim 2, wherein said at least one clip is L-shaped having horizontal and vertical legs, said vertical leg attached to said antenna mount at a side of said casing and said horizontal leg seated upon the body of the motor vehicle adjacent the hole formed therein.

4. The combination recited in claim 2, wherein said at least one clip is a rectangular plate attached to and extending outwardly from the top of the casing of said antenna mount.

5. The combination recited in claim 1, wherein the casing of said antenna mount includes an access opening formed therein, a cable access channel extending through said casing from said access opening, and a coaxial cable running through said cable access channel to be electrically connected at a first end to said radio and at the opposite end to said antenna at said access opening.

6. The combination recited in claim 5, wherein said coaxial cable has an outer shield and an inner signal carrying conductor that is surrounded by said outer shield, said outer shield being connected to the casing of said antenna mount within said access opening.

7. The combination recited in claim 7, further comprising a threaded bolt extending from said access opening outwardly through said casing, said signal carrying conductor of said coaxial cable being connected to said threaded bolt within said access opening.

8. The combination recited in claim 7, further comprising a threaded antenna mounting nut mated to said threaded bolt outside the casing of said antenna mount so as to receive said antenna, said signal carrying conductor of said coaxial cable being electrically connected to said antenna by way of said threaded bolt and said antenna mounting nut.

9. The combination recited in claim 5, further comprising a hollow tie down bolt extending through the bottom of said cavity in the body of the motor vehicle, said hollow tie down bolt attached to the casing of said antenna mount at said cable access channel thereof, said coaxial cable running through said cable access channel and said hollow tie down bolt to be electrically connected to said radio.

10. The combination recited in claim 1, wherein the casing of said antenna mount includes an upper access opening formed therein and located at one end of said antenna mount, a lower access opening formed in said casing and located at the opposite end of said antenna mount, a cable access channel extending between said upper and lower access openings, and a coaxial cable running through said cable access channel so as to be electrically connected to the antenna at said upper access opening and the radio at said lower access opening.

11. The combination recited in claim 10, wherein said coaxial cable has an outer shield and an inner signal carrying conductor that is surrounded by said outer shield, said outer shield being connected to the casing of said antenna mount within said upper access opening.

12. The combination recited in claim 11, further comprising a threaded bolt extending from said upper access opening outwardly through said casing, said signal carrying conductor of said coaxial cable being connected to said threaded bolt within said access opening.

13. The combination recited in claim 12, further comprising a threaded antenna mounting nut mated to said threaded bolt outside the casing of said antenna mount so as to receive said antenna, said signal carrying conductor of said coaxial cable being electrically connected to said antenna by way of said threaded bolt and said antenna mounting nut.

14. The combination recited in claim 10, further comprising a coaxial cable connector connected to said coaxial cable at said lower access opening through the casing of said antenna mount, said coaxial cable connector.

15. The combination recited in claim 14, further comprising a barrel connector extending through the bottom of said cavity in the body of the motor vehicle and through the casing of said antenna mount to anchor said antenna mount in said cavity, said coaxial cable connector being connected to one end of said barrel connector at said lower access opening and the radio being connected to the opposite end of said barrel connector whereby to electrically connect said antenna to said radio.

16. In combination:

a motor vehicle having an electrically conductive body, a radio, an antenna to transmit and receive radio signals, at least one hole formed in the body, and a cavity extending through said body from said hole and having a closed bottom; and an antenna mount to which said antenna is attached, said antenna mount having a casing that is located in said hole for receipt by said cavity through the body of said motor vehicle, wherein the casing of said antenna mount includes at least one access opening formed therein, a cable access channel extending through said casing from said access opening, and a coaxial cable running through said cable access channel, said coaxial having an outer shield and an inner signal carrying conductor that is surrounded by said outer shield, said inner signal carrying conductor electrically connected between the antenna and the radio, said outer shield electrically connected to the casing of said antenna mount within said access opening, and said casing electrically connected to the body of said motor vehicle.

17. The combination recited in claim 16, further comprising a threaded bolt extending from said access opening outwardly through said casing, said signal carrying conductor of said coaxial cable being connected to said threaded bolt within said access opening.

18. The combination recited in claim 17, further comprising a threaded antenna mounting nut mated to said threaded bolt outside the casing of said antenna mount so as to receive said antenna, the signal carrying conductor of said coaxial cable being electrically connected to the antenna by way of said threaded bolt and said antenna mounting nut.

19. The combination recited in claim 16, further comprising a hollow tie down bolt for securing the casing of said antenna mount within the cavity of the body of the motor vehicle, said hollow tie down bolt being attached to said casing at said cable access channel, said coaxial cable running through each of said cable access channel and said hollow tie down bolt to be electrically connected to said radio.

20. The combination recited in claim 16, wherein the casing of said antenna mount includes an upper access opening located at one end of said antenna mount and a lower access opening located at the opposite end of said antenna mount, said cable access channel extending between said upper and lower access openings, and said coaxial cable running through said cable access channel so that the inner signal carrying conductor thereof is electrically connected to the antenna at said upper access opening and to the radio at said lower access opening.

* * * * *